US008763288B2

(12) United States Patent
Emoff

(10) Patent No.: US 8,763,288 B2
(45) Date of Patent: Jul. 1, 2014

(54) FOLDED DISPLAY WITH OPTIONAL DISPENSER

(71) Applicant: Outta The Box Dispensers, LLC, Dayton, OH (US)

(72) Inventor: Michael J. Emoff, Dayton, OH (US)

(73) Assignee: Outta The Box Dispensers, LLC, Dayton, OH (US)

( * ) Notice: Subject to any disclaimer, the term of this patent is extended or adjusted under 35 U.S.C. 154(b) by 26 days.

(21) Appl. No.: 13/706,494

(22) Filed: Dec. 6, 2012

(65) Prior Publication Data

US 2013/0240557 A1 Sep. 19, 2013

Related U.S. Application Data

(60) Provisional application No. 61/612,041, filed on Mar. 16, 2012.

(51) Int. Cl.
*G09F 1/08* (2006.01)

(52) U.S. Cl.
USPC ..... 40/539; 40/606.18

(58) Field of Classification Search
USPC ..... 40/539, 610, 606.18
See application file for complete search history.

(56) References Cited

U.S. PATENT DOCUMENTS

| | | | | | |
|---|---|---|---|---|---|
| 2,252,571 | A * | 8/1941 | Kohn | 248/459 |
| 2,881,662 | A * | 4/1959 | Harris | 248/472 |
| 3,471,958 | A * | 10/1969 | Westin | 40/592 |
| 3,690,620 | A * | 9/1972 | Matson et al. | 256/64 |
| 4,130,197 | A * | 12/1978 | Fox | 206/45.26 |
| 4,977,697 | A * | 12/1990 | Genick | 40/610 |
| 6,170,183 | B1 * | 1/2001 | Keefe | 40/607.03 |
| 2006/0011643 | A1 * | 1/2006 | Emoff et al. | 221/36 |
| 2009/0235860 | A1 * | 9/2009 | Julnes | 116/63 C |

FOREIGN PATENT DOCUMENTS

GB 2086116 A * 5/1982 ..... G09F 1/06

* cited by examiner

*Primary Examiner* — Gary Hoge
(74) *Attorney, Agent, or Firm* — Walters & Wasylyna LLC

(57) ABSTRACT

A display including a first panel connected to a second panel along a seam, wherein the first panel includes a first edge opposed from the seam and the second panel includes a second edge opposed from the seam, at least one first tab connected to the first panel along the first edge, and at least one second tab connected to the second panel along the second edge, wherein the first panel is folded relative to the second panel along the seam such that the first tab is engaged with the second tab such that engagement between the first tab and the second tab fixedly aligns the first panel relative to the second panel.

19 Claims, 4 Drawing Sheets

FOLDED DISPLAY WITH OPTIONAL DISPENSER

PRIORITY

This application claims priority from U.S. Ser. No. 61/612,041 filed on Mar. 16, 2012, the entire contents of which are incorporated herein by reference.

FIELD

The present disclosure is generally related to advertising displays and, more particularly, to foldable advertising displays that incorporate a coupon dispensing system.

BACKGROUND

Placard advertising, particularly outdoor placard advertising, is well known in the art as an effective way to advertise products at point-of-sale and other similar locations. For example, with the advent of "pay at the pump" systems, such as those seen at gas stations, consumers equipped with a credit card have little or no reason to enter the convenience mart or other store typically accompanying the gas station. The use of placard advertising at the pump may provide an enticement to lure the consumer from the pump and into the convenience mart. Use of a coupon dispenser in conjunction with the placard advertising may provide additional enticement to the consumer.

One disadvantage to outdoor placard advertising is that it must be constructed in such a manner as to withstand the elements. Corrugated materials are generally preferred because of their ability to provide rigidity, and a polymer-based corrugated material such as COROPLAST® provides a suitable weatherproof rigid material. However, there still exists a need for placard advertising formed of corrugated material in a manner that it is capable of being easily attached to a wide variety of structures and capable of withstanding outdoor elements such as wind, snow, rain and the like.

Accordingly, those skilled in the art continue with research and development efforts in the field of placard advertising and displays.

SUMMARY

In one embodiment, the disclosed display may include a first panel connected to a second panel along a seam, wherein the first panel includes a first edge opposed from the seam and the second panel includes a second edge opposed from the seam, at least one first tab connected to the first panel along the first edge, and at least one second tab connected to the second panel along the second edge, wherein the first panel is folded relative to the second panel along the seam such that the first tab is engaged with the second tab such that engagement between the first tab and the second tab fixedly aligns the first panel relative to the second panel.

In another embodiment, the disclosed display may include a polymeric board including a first panel connected to a second panel along a seam, wherein the first panel includes a first edge opposed from the seam and the second panel includes a second edge opposed from the seam, at least one first tab having a coated surface and connected to the first panel along the first edge by a first fold line, at least one second tab having a coated surface and connected to the second panel along the second edge by a second fold line, a very high bond adhesive affixed to at least one of the coated surface of the first tab and the coated surface of the second tab; a dispenser connected to at least one of the first panel and the second panel, wherein the first tab engages the second tab to fixedly aligned the first panel relative to the second panel when the first panel is folded relative to the second panel along the seam.

In yet another embodiment, disclosed is a method of forming a display, the method may include the steps of: (1) providing a substrate body, (2) forming a first panel and an adjacent second panel along a seam from the substrate body, wherein the first panel includes a first edge opposed from the seam and the second panel includes a second edge opposed from the seam, (3) forming at least one first tab from the substrate body, wherein the first tab is connected to the first panel along the first edge, (4) forming at least one second tab from the substrate body, wherein the second tab is connected to the second panel along the second edge, (5) scoring the substrate body along the seam, and (6) folding the first panel relative the second panel along the seam such that the first tab engages with the second tab, wherein engagement between the first tab and the second tab fixedly aligns the first panel relative to the second panel.

Other embodiments of the disclosed display will become apparent from the following detailed description, the accompanying drawings and the appended claims.

DETAILED DESCRIPTION

Figure 1:
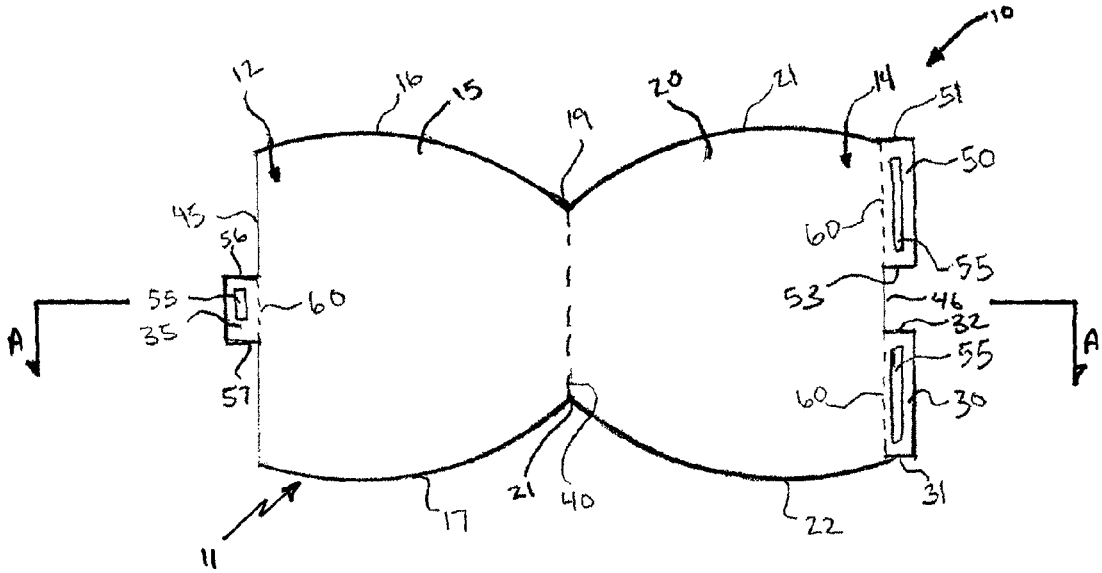
FIG. 1 is a front elevation view of one embodiment of the disclosed display depicted in a flattened configuration.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Referring to FIG. 1, one embodiment of the disclosed display, generally designated 10, may include a substrate body 11 defining a first panel 12 and a second panel 14. A seam 40 may extend laterally (i.e., vertically) through a middle of the body 11 between the first panel 12 and the second panel 14. Therefore, the seam 40 may divide the body 11 generally in half, such that the panels 12, 14 may be generally identical in size and shape.

Those skilled in the art will appreciate that a variety of substrates may be used to form the body 11. In one particular expression, the substrate may be any suitable polymeric substrate capable of withstanding outdoor conditions. One general, non-limiting example of a suitable polymeric substrate for forming the body 11 may be polymeric corrugated board.

One specific, non-limiting example of a suitable substrate for forming the body 11 may be a polymer-based, extruded twin-wall corrugated board produced from high-impact polypropylene resin, such as COROPLAST® board available from Coroplast, Inc. of Dallas, Tex. The use of non-polymeric materials to form the substrate of the body 11 is also contemplated; for example fiberboard or laminated materials may be used, which may optionally be coated with a weather resistant coating.

Figure 2:
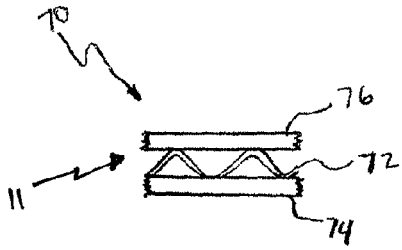
FIG. 2 is a cross-sectional view of the disclosed display taken along section line A-A of FIG. 1.

Referring to FIG. 2, the body 11 may include a corrugated substrate 70 having an interior fluted corrugated sheet 72 interposed between a first linerboard 74 and a second linerboard 76 (i.e., faces). While two linerboards 74, 76 and a single fluted sheet 72 are shown and described herein; those skilled in the art will appreciate that the substrate 70 may contain one or more linerboards and two or more fluted sheets. For example, the corrugated board material may include various structural configurations including single wall, double wall, or tri-wall corrugated board being either single of double-faced and having a variety of flute designs.

Furthermore, the fluted sheet 72 may have any dimensions now known or later developed in the art as being suitable for fluted sheets in corrugated materials, particularly polymer-based corrugated materials, as described herein. The sinusoidal configuration of the fluted sheet 72 shown in FIG. 2 is just one non-limiting example.

Similarly, the two linerboards 74, 76 may also have any dimensions now known or later developed in the art as being suitable for liner boards in corrugated materials, particularly polymer-based corrugated materials, as described herein.

The corrugated substrate 70 may have a suitable stiffness or rigidity in order to use the body 11 as a support structure of the disclosed display 10. For example, the corrugated substrate 70 may be suitably stiff or rigid enough to support a coupon dispenser 42 (FIGS. 8 and 9), as described in more detail herein.

Furthermore, the corrugated substrate 70 may be sufficiently flexible or malleable to allow the body 11 to be scored, folded, bent, molded or otherwise formed in a manner consistent with the present disclosure without tearing or ripping of the body 11.

The corrugated substrate 70 may include any color or combination of colors. Furthermore, the corrugated substrate 70 may have two major surfaces (i.e., the first linerboard 74 and a second linerboard 76) for painting, drawing, printing, highlighting and the like.

Referring back to FIG. 1, the body 11 of the display 10 may be formed by any formation process now known or later developed, such as die-cutting a blank of the corrugated substrate 70 in accordance with cutting processes known in the art. Further, the body 11 may be formed to include various shapes or sizes.

The seam 40 may be formed by at least partially scoring or perforating the body 11. Alternatively, the seam 40 may be formed by an indentation or crease along the body 11. The seam 40 may be aligned with the fluting of the corrugated substrate 70 (i.e., in a direction perpendicular to the arc direction of the fluted sheet 72) in order to make the body 11 easy to fold about the seam 40.

Alternatively, the body 11 of the display 10 may be formed by connecting the first panel 12 and the second panel 14 about the seam 40. The seam 40 may be formed by any process now known or later developed for attaching or otherwise connecting separate panels of corrugated substrate 70 along opposing and aligned edges.

The seam 40 may be generally straight, and may extend vertically from a first point 19 of the body 11 (i.e., where a top edge 16 of the first panel 12 meets a top edge 21 of the second panel 14) to a laterally opposed second point 21 of the body 11 (i.e., where a bottom edge 17 of the first panel 12 meets a bottom edge 22 of the second panel 14). Alternatively, the seam 40 may extend only partially through the body 11 and may not extend all the way to the first point 19 or the second point 21.

As discussed above, in one embodiment of the disclosed display 10, the body 11 may be divided generally in half by the seam 40 to form the first panel 12 and the second panel 14. The first panel 12 may be defined by the seam 40, the top edge 16, the bottom edge 17 and a back edge 45. While the present figure depicts the first panel 12 having four (4) sides, it can be appreciated that the first panel 12 may have any number of sides and any geometric shape. Additionally, the top edge 16, the bottom edge 17, or the back edge 45 may be straight, wavy, or curved, depending on the type and overall shape of the display 10 desired.

The first panel 12 may further include a surface such as a front face 15 that is generally outwardly facing and viewable when the body 11 is folded about the seam 40 and displayed in a manner in accordance with the present disclosure. The front face 15 may be an exterior surface of one of the linerboards 74, 76, or alternatively may be a secondary surface attached or otherwise connected over the exterior surface of one of the linerboards 74, 76. The front face 15 may further contain a coupon dispenser 42 (FIG. 8) or other components attached thereto, as described in more detail herein.

The body 11 may further include a middle tab 35 affixed to or integral to the back edge 45 of the first panel 12. While the present disclosure depicts a single tab, it may be appreciated that multiple tabs may be used. The middle tab 35 may be cut as part of the display 10 from the corrugated substrate blank (i.e., the middle tab 35 and the body 11 may be formed as a single unitary body), or the middle tab 35 may be attached to the body 11 after formation of the display 10.

The middle tab 35 may extend generally beyond the boundary defined by the back edge 45 of the first panel 12. In embodiments of the display 10 where the middle tab 35 is integrally formed as a part of the body 11, the middle tab 35 may be defined by a tab fold line 60 that is collinear with the back edge 45 of the first panel 12 in such a way that the tab fold line 60 allows the middle tab 35 to be easily folded at an angle away from the body 11 along the tab fold line 60. For example, the middle tab 35 may be folded in such a way that it is generally perpendicular to the plane of the first panel 12.

The tab fold line 60 may be formed by scoring, perforating, indenting, creasing or folding an area of the corrugated substrate 70 between the middle tab 35 and the first panel 12 along the back edge 45. Similarly to the seam 40, the tab fold line 60 may be aligned with the fluting of the corrugated substrate to make the middle tab 35 easy to fold along the tab fold line 60.

The tab fold line 60 may be generally straight and may aligned collinearly with the back edge 45, extending from proximate a top edge 56 of the middle tab 35 to proximate a bottom edge 57 of the middle tab 35.

The second panel 14 may be defined by the seam 40, the top edge 21, the bottom edge 22 and a back edge 46. While the present disclosure depicts the second panel 14 having four (4) sides, it can be appreciated that the second panel 14 may have any number of sides and any geometric shape. Additionally, the top edge 21, the bottom edge 22, or the back edge 46 may be straight, wavy or curved, depending on the type and overall shape of display 10 desired. The top edge 21, the bottom edge 22, or the back edge 46 may also match the straightness, waviness, or curviness of the respective top edge 16, the bottom edge 17, or the back edge 45 of the first panel 12, as described herein, such that the first panel 12 and second panel 14 have essentially matching shapes and sizes.

The second panel 14 may further include a surface such as a front face 20 that is generally outwardly facing and viewable when the body 10 is folded about the seam 40 and displayed in a manner in accordance with the present disclosure. The second face 20 may be an exterior surface of one of the linerboards 74, 76, or alternatively may be a secondary surface attached or otherwise connected over the exterior surface of one of the linerboards 74, 76. The front face 20 may further contain a coupon dispenser 42 (FIG. 9) or other components attached thereto, as described in more detail herein.

The body 11 may further contain one or more tabs 30, 50 affixed to or integral to the back edge 46 of the second panel 14. While the present disclosure depicts a top tab 30 and a bottom tab 50, it may be appreciated that other numbers of tabs may be used. The tabs 30, 50 may be cut as part of the display 10 from the corrugated substrate blank (i.e., the top tab 30, bottom tab 50, and the body 11 may be formed as a single unitary body), or may be attached to the body 11 after formation of the display 10.

The tabs 30, 50 may extend generally beyond the boundary defined by the back edge 46. In embodiments where the tabs 30, 50 are integrally formed as a part of the body 11, the tabs 30, 50 may be defined by one or more tab fold lines 60 that may be collinear with the back edge 46 of the second panel 14 in such a way that the tab fold lines 60 allow the tabs 30, 50 to be easily folded at an angle away from the display along the tab fold lines 60. For example, the tabs 30, 50 may be folded in such a way that it is generally perpendicular to the plane of the second panel 14.

The tab fold lines 60 may be formed by scoring, perforating, indenting, creasing or folding an area of the corrugated substrate 70 between the tabs 30, 50 and the second panel 14 along the back edge 46. Similarly to the seam 40, the tab fold line 60 may be aligned with the fluting of the corrugated substrate to make the tabs 30, 50 easy to fold at the tab fold lines 60.

The tab fold lines 60 may be generally straight and may be aligned collinearly with the back edge 46, extending from proximate a top edge 51 of the top tab 50 to proximate a bottom edge 53 of the top tab 50, as well as being aligned collinearly with the back edge 46 from proximate a top edge 32 of the bottom tab 30 to proximate a bottom edge 31 of the bottom tab 30.

Figure 3:
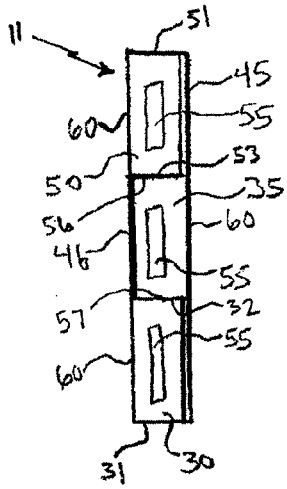
FIG. 3 is a rear elevation view of the disclosed display depicted in a folded configuration.

Referring to FIG. 3, in one embodiment of the disclosed display 10, the middle tab 35 may be positioned in such a way that when the body 11 is folded along the seam 40 (FIG. 1), it joins the top and bottom tabs 30, 50. The three tabs 30, 35, 50 may be joined together in such a way that they precisely align with each other in an interlocking manner, such as a tongue-and-groove fashion, thereby fixing the first panel 12 into precise alignment with the second panel 14. In this instance, the bottom edge 53 of the top tab 50 is substantially parallel and aligned with the top edge 56 of the middle tab 35, and the top edge 32 of the bottom tab 30 is substantially parallel and aligned with the bottom edge 57 of the middle tab 35.

Figure 4:
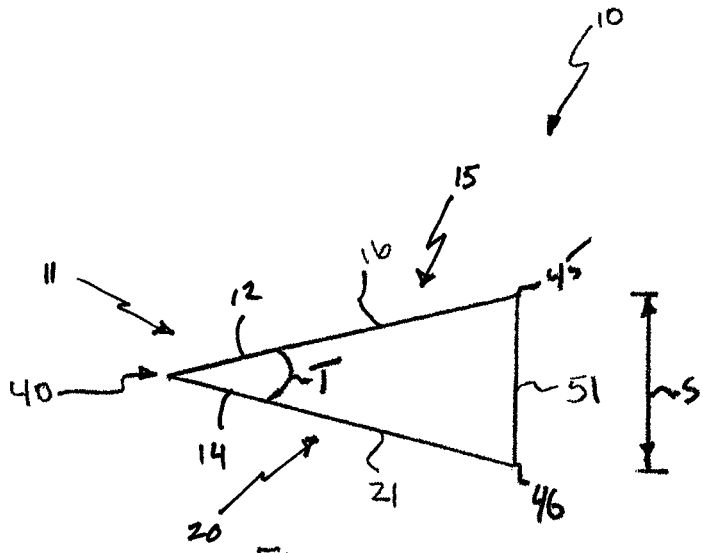
FIG. 4 is a top plan view of the disclosed display of FIG. 3.

Referring to FIG. 4, when the body 11 is folded along the seam 40 and viewed from the top, it may appear generally triangular in shape. From this view, the top edge 16 of the first panel and the top edge 21 of the second panel are viewable, as well as the top edge 51 of the top tab 50.

Figure 5:
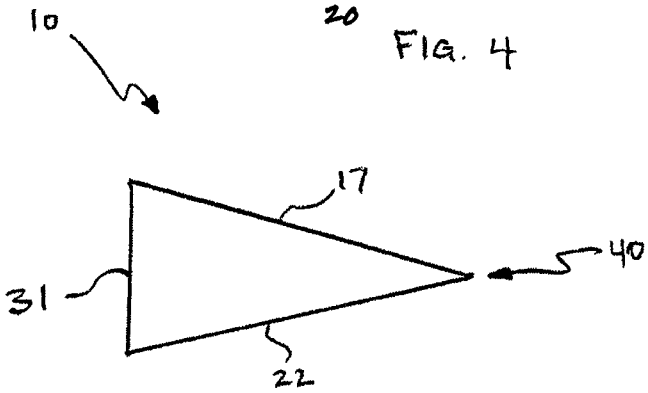
FIG. 5 is a bottom plan view of the disclosed display of FIG. 3.

Referring to FIG. 5, when the body 11 is folded along the seam 40 and viewed from the bottom, it may also appear generally triangular in shape. From this view, the bottom edge 17 of the first panel and the bottom edge 22 of the second panel are viewable, as well as the bottom edge 31 of the bottom tab 30.

The triangular shape of the display 10 in top view may be due to spacing S (FIG. 4) of the back edge 45 of the first panel 12 from the back edge 46 of the second panel 14. Those skilled in the art will appreciate that spacing S and the length of the first and second panels 12, 14 may dictate an angle T of the first panel 12 relative to the second panel 14. In one construction, the spacing S may be at least one-half (0.5) inch (1.27 cm). In another construction, the spacing S may be at least one (1) inch (2.54 cm). In another construction, the spacing S may be at least one and half (1.5) inches (3.81 cm). In yet another construction, the spacing S may be at least two (2) inches (5.08 cm). Those skilled in the art will appreciate that a larger spacing S may provide a larger surface area for any adhesive 55 (FIGS. 3 and 7), as will be discussed in further detail below, and, hence, greater adhesion of the display 10 to the support structure.

Figure 7:
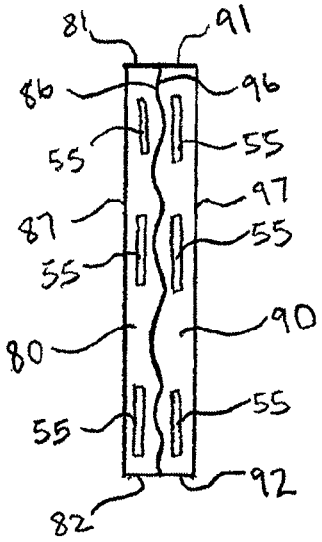
FIG. 7 is a rear elevation view of the disclosed display of FIG. 6 depicted in a folded configuration.
Figure 6:
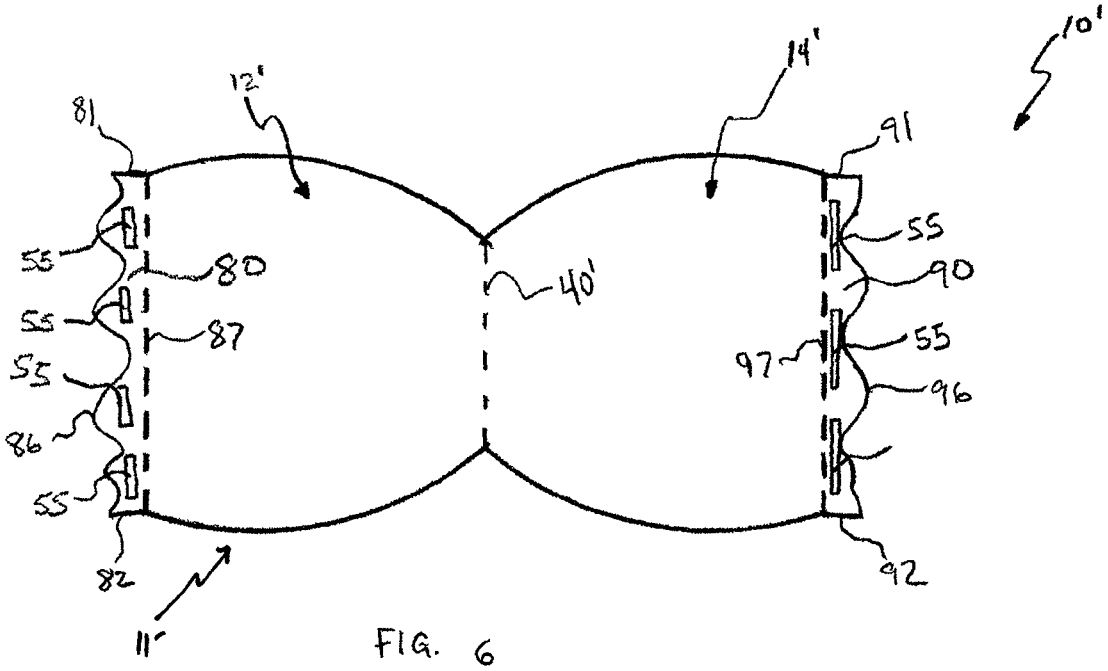
FIG. 6 is a front elevation view of another embodiment of the disclosed display depicted in a flattened configuration.

Referring to FIGS. 6 and 7, another embodiment of the disclosed display, generally designated 10', may include a substrate body 11' defining a first panel 12' and a second panel 14'. A seam 40' may extend laterally (i.e., vertically) through a middle of the body 11' between the first panel 12' and the second panel 14'. Therefore, the seam 40' may divide the body 11' generally in half, such that the panels 12', 14' may be generally identical in size and shape.

The body 11' may also include a first 80 and a second tab 90 extending beyond the first and second panels 12', 14', respectively. The first tab 80 may be affixed to or integral to the first panel 12' and may be defined by a top edge 81, a bottom edge 82, a first fold line 87 and a contoured edge 86. The second tab 90 may be affixed to or integral to the second panel 14' and may be defined by a top edge 91, a bottom edge 92, a second fold line 97 and a contoured edge 96.

The first fold line 87 may formed by scoring, perforating, indenting, creasing or folding an area of the corrugated substrate 70 between the tab 80 and the first panel 12'. The second fold line 97 may formed by scoring, perforating, indenting, creasing or folding an area of the corrugated substrate 70 between the tab 90 and the second panel 14'. The fold lines 87, 97 may be aligned with the fluting of the corrugated substrate 70 to make the tabs 80, 90 easy to fold at the respective fold lines 87, 97. For example, the first tab 80 may be folded along the first fold line 87 in such a way that the first tab 80 is generally perpendicular to the plane of the first panel 12'. Likewise, the second tab 90 may be folded along the second fold line 97 in such a way that the second tab 90 is generally perpendicular to the plane of the second panel 14'.

The first fold line 87 may be generally straight and may extend laterally (i.e., vertically) from the top edge 81 of the first tab 80 to the bottom edge 82 of the first tab 80. Likewise, the second fold line 97 may generally be straight and may extend laterally (i.e., vertically) from the top edge 91 of the second tab 90 to the bottom edge 92 of the second tab 90.

The contoured edge 86 of the first tab 80 may be curved in such a way that the hills and valleys of the edge are an inverse of the hills and valleys of the corresponding contoured edge 96 of the second tab 90. Accordingly, when the body 11' is folded along the seam 40' and the tabs 80, 90 are folded along their respective fold lines 87, 97 as described herein, the contoured edge 86 of the first tab 80 mates with the contoured edge 96 of the second tab 90 and forms a fitted, interlocking engagement, as depicted in FIG. 7, thereby fixing the first panel 12' into precise alignment with the second panel 14'.

While two different embodiments (FIGS. 1 and 6) have been shown and described, those skilled in the art may appreciate other tab designs, including but not limited to other types of interlocking tabs, overlapping tabs and the like, may be used without departing from the scope of the present disclosure.

As shown in FIGS. 1, 2, 6 and 7, the tabs 30, 35, 50, 80, 90 may include an adhesive 55. The adhesive 55 may be positioned in such a way that when the body 11, 11' is folded along the seam 40, 40' and the tabs 30, 35, 50, 80, 90 are folded along the tab fold lines 60, 87, 97, respectively, the adhesive 55 faces outwardly. The outwardly facing orientation of the adhesive 55 may facilitate connection of the display 10 to a support structure (e.g., a wall, a window, a pillar, a gas pump or the like), thereby fixing the first panel 12, 12' in alignment with the second panel 14, 14'.

While the present disclosure depicts the adhesive 55 as varying numbers of adhesive patches affixed to the tabs 30, 35, 50, 80, 90 (FIGS. 3 and 7), those skilled in the art will recognize that any number of adhesive patches (e.g., only one) may be used. Furthermore, the size and shape of the adhesive 55 may be any suitable size and shape, and the size and shape of particular adhesives 55 may vary on the same display 10. The adhesive 55 may further cover the entire surface of a tab 30, 35, 50, 80, 90, or alternatively may only cover a portion of the surface of a tab 30, 35, 50, 80, 90.

The adhesive 55 may be any adhesive suitable for affixing the display 10 to a supportive object capable of holding the display 10, as described in greater detail herein. Examples of suitable adhesives may include, but are not limited to; tape (e.g., double-sided tape), glue, or any other chemically bonded adhesive material. As an alternative to adhesives, those skilled in the art will appreciate that other means of fixture may also be used, such as nails, screws, staples and the like.

Figure 9:
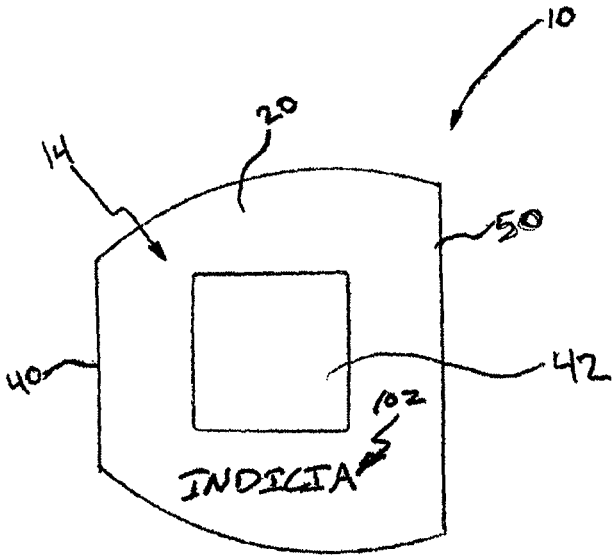
Figure 8:
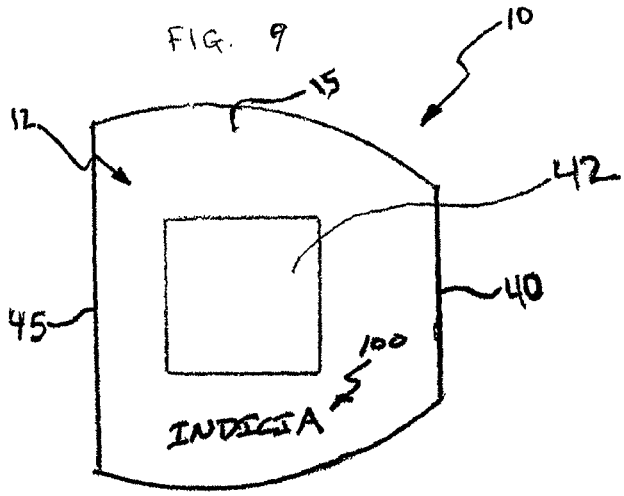
FIG. 8 is a first side elevation view of yet another embodiment of the disclosed display; and, FIG. 9 is a second side elevation view of the display of FIG. 8.

As a particular, non-limiting example, the adhesive 55 may include a very high bond (VHB) adhesive product. For example, the adhesive 55 may be a very high bond adhesive tape that is stretchable to break the bond with the underlying support structure, such as style VHB 4951 adhesive tape provided by 3M Company. Such a VHB adhesive tape may very securely hold the display 10 to the support structure (e.g., a self service gas pump) when an advertisement, flyer, credit card application, or other product or material is removed from the display 10, 10', such as products or materials stored in the coupon dispenser 42 (FIGS. 8 and 9). For example, such VHB tape used as the adhesive 55 may remain on a metal surface, such as that which typically surrounds a gas pump. To remove the adhesive 55, a corner may simply need to be partially peeled and pulled, which may cause the tape (i.e., adhesive 55) to expand or stretch to release the bond between the display 10, 10' and the support structure.

Thus, a stretchable VHB adhesive tape, such as VHB 4951 adhesive tape, may provide a strong bond to the support structure, but may be quickly and easily removable from the support structure by stretching the adhesive tape to break the bond. Additionally, a stretchable VHB adhesive tape, such as VHB 4951 adhesive tape, may leave little (or no) residue on the support structure after removal.

As another particular, non-limiting example, the surface of the tabs 30, 35, 50, 80, 90 may be flood printed with an ink or other coating to which the adhesive 55 may be applied. For example, adhesive 55 may not adequately adhere to certain corrugated substrate materials, such as polymeric corrugated board. Printing ink or similar exterior coatings bond well with polymeric corrugated board and adhesive 55 may more securely bond to such ink or coating. Once adhesive 55, such as the 3M style VHB 4951 tape discussed above, bonds to the coated surface of the tabs 30, 35, 50, 80, 90, it provides a secure adhesive bond between the display 10, 10' and the support structure. Alternatively, the entire body 11, 11', including the tabs 30, 35, 50, 80, 90, may be flood printed with the ink or other coating.

The body 11 may be folded along the seam 40 such that the front face 15 of the first panel 12 faces in the opposite direction as the front face 20 of the second panel 14 (FIG. 4).

Referring to FIGS. 8 and 9, when the body 11 is folded about the seam 40, a direct view of the first panel 12 may hide the second panel 14 from view. Accordingly, a direct view of the second panel 14 may hide the first panel 12 from view.

The front face 15 of the first panel 12 may contain advertising indicia 100 (FIG. 8), such as graphics, text and the like. The advertising indicia 100 may be printed, painted, drawn, embossed, or written directly on the front face 15 of the corrugated substrate 70. Likewise, the front face 20 of the second panel 14 may also contain advertising indicia 102 (FIG. 9), such as graphics, text and the like, which may be printed, painted, drawn, embossed, or written directly on the second face 20 of the corrugated substrate 70. The advertising indicia 100 displayed on the first panel 12 may be identical to the advertising indicia 102 displayed on the second panel 14. Alternatively, the advertising indicia 100 displayed on the first panel 12 may be different than the advertising indicia 102 displayed on the second panel 14

In addition to the advertising indicia 100, 102, one or both of the first panel 12 and second panel 14 may include additional devices, advertisements, or indicia attached to a portion of their respective front faces 15, 20. One example of a device that may be attached to either or both of the front faces 15, 20 is a coupon dispenser 42, such as the coupon dispenser disclosed in U.S. Patent Pub. No. 2006/0011643 to Emoff et al., the entire contents of which are incorporated herein by reference. The Emoff publication discloses a disposable coupon dispenser that is particularly suitable for use outdoors because of water-resistant properties of the dispenser and the coupons. The adhesive-coated back surface of the coupon dispenser 42 may be suited for attachment to one or both of the front faces 15, 20. The size of the coupon dispenser 42 may match the size of one of the front faces 15, 20, may be larger, or may be smaller than the size of one of the front faces 15, 20.

Although various embodiments of the disclosed display have been shown and described, modifications may occur to those skilled in the art upon reading the specification. The present application includes such modifications and is limited only by the scope of the claims.

What is claimed is:

1. A display comprising:

a first panel connected to a second panel along a seam, wherein said first panel comprises a first edge opposed from said seam and said second panel comprises a second edge opposed from said seam;

a first tab connected to said first panel along said first edge, said first tab comprising a first face coated with an ink coating; and a second tab connected to said second panel along said second edge, said second tab comprising a second face coated with said ink coating, wherein said first panel is foldable relative to said second panel along said seam such that said first tab engages said second tab, and wherein engagement between said first tab and said second tab aligns said first panel relative to said second panel.

2. The display of claim 1 wherein said first tab is connected to said first edge along a first pre-formed fold line and said second tab is connected to said second edge along a second pre-formed fold line.

3. The display of claim 1 further comprising a third tab connected to said second panel along said second edge and spaced apart from said second tab.

4. The display of claim 1 wherein said first tab defines a first contoured edge and said second tab defines a second contoured edge.

5. The display of claim 1 further comprising a first adhesive connected to said first tab and a second adhesive connected to said second tab.

6. The display of claim 5 wherein at least one of said first adhesive and said second adhesive comprises a double-sided tape.

7. The display of claim 5 wherein at least one of said first adhesive and said second adhesive comprises a stretchable very high bond adhesive tape.

8. The display of claim 1 wherein said first panel and said second panel are formed from a polymeric board.

9. The display of claim 1 wherein said first panel and said second panel are formed from a unitary body.

10. The display of claim 9 wherein said body comprises a polymeric corrugated board.

11. The display of claim 1 wherein said first panel comprises a first surface and said second panel comprises a second surface, and wherein at least one of said first surface and said second surface is marked with indicia.

12. The display of claim 1 further comprising a dispenser connected to at least one of said first panel and said second panel.

13. The display of claim 12 wherein said dispenser comprises a plurality of water-resistant coupons.

14. The display of claim 1 wherein said first tab and said second tab are flood printed with said ink coating.

15. The display of claim 14 further comprising a stretchable very high bond adhesive tape applied to said flood printed ink coating.

16. A folded display comprising:

a first panel connected to a second panel along a seam, wherein said first panel comprises a first edge opposed from said seam and said second panel comprises a second edge opposed from said seam;

a first tab connected to said first panel along said first edge, wherein said first tab comprises a first face, at least a portion of said first face comprising an ink coating; and a second tab connected to said second panel along said second edge, wherein said second tab comprises a second face, at least a portion of said second face comprising an ink coating.

17. The folded display of claim 16 wherein said first and said second panels are formed from polymeric corrugated board.

18. The folded display of claim 16 wherein said first and said second tabs space said first edge a distance from said second edge, wherein said distance is at least 0.5 inches.

19. A polymeric board display comprising:

a first panel connected to a second panel along a seam, wherein said first panel comprises a first edge opposed from said seam and said second panel comprises a second edge opposed from said seam;

a first tab comprising an ink coated surface and connected to said first panel along said first edge by a first fold line;

a second tab comprising an ink coated surface and connected to said second panel along said second edge by a second fold line;

a very high bond adhesive affixed to at least one of said ink coated surface of said first tab and said ink coated surface of said second tab; and a dispenser connected to at least one of said first panel and said second panel, wherein said first tab is engaged with said second tab to align said first panel relative to said second panel.

* * * * *